US006216985B1

(12) United States Patent
Stephens

(10) Patent No.: US 6,216,985 B1
(45) Date of Patent: Apr. 17, 2001

(54) RAILWAY HAZARD ACOUSTIC SENSING, LOCATING, AND ALARM SYSTEM

(76) Inventor: Robert Douglas Stephens, 3862 Sefton Street, Port Coquitlam, British Columbia (CA), V3B 3R9

( * ) Notice: Subject to any disclaimer, the term of this patent is extended or adjusted under 35 U.S.C. 154(b) by 0 days.

(21) Appl. No.: 09/134,628

(22) Filed: Aug. 13, 1998

(51) Int. Cl.[7] ..... B61L 23/00

(52) U.S. Cl. ..... 246/120; 246/121; 246/167 R; 246/122 R; 246/486; 246/473 R; 73/579

(58) Field of Search ..... 246/120, 121, 246/167 R, 122 R, 486, 473 R; 73/579

(56) References Cited

U.S. PATENT DOCUMENTS

| | | | | |
|---|---|---|---|---|
| 4,402,210 | | 9/1983 | Vanderberg | 73/12 |
| 4,752,053 | * | 6/1988 | Boetzkes | 246/167 R |
| 5,301,082 | * | 4/1994 | Stolarczyk et al. | 361/58 |
| 5,429,329 | | 7/1995 | Wallace et al. | 246/166 |
| 5,574,224 | | 11/1996 | Jaeggi | 73/636 |
| 5,623,244 | | 4/1997 | Cooper et al. | 340/425.5 |
| 5,627,508 | | 5/1997 | Cooper et al. | 340/425.5 |
| 5,713,540 | * | 2/1998 | Gerszberg et al. | 246/121 |
| 5,986,547 | * | 11/1999 | Koever et al. | 340/500 |

FOREIGN PATENT DOCUMENTS 1 278 353 12/1990 (CA) .

OTHER PUBLICATIONS

Report No. R95V 0017 1997 Transport Safety Board of Canada.

Report No. R97V 0063 1997 Transport Safety Board of Canada.

Canadian Rail Operating Rules 1996 Rules.

Report No. R96C 0172 1998 Transport Safety Board of Canada.

* cited by examiner

*Primary Examiner*—Joseph Morano
*Assistant Examiner*—Frantz F. Jules

(57) ABSTRACT

A highly reliable early warning system is disclosed. The warning system provides immediate detection of railway activity and early warning of dangerous railway conditions to train crews and to Rail Traffic Control offices. The warning system has acoustic sensors coupled to one of the rails of a railway for detecting sound or vibration transmitted from physical events. The detected acoustic signals are analyzed by a computer sound recognition system to ascertain the nature of the event causing the signal. If a suspect condition is identified or an unrecognized high energy acoustic signature is detected, an alarm is generated. The alarm signal may be transmitted over any communication system to the Rail Traffic Control office and to the trains traveling toward the suspect track location. The system can also detect railway rolling stock problems such as flat spots on wheels or derailed cars. When desired, the alarm may employ wireless transmissions to stop the trains remotely. When more than one acoustic sensor detects the same event, the exact location can be determined. Any physical events that are detected may be stored in a sound file. These may be catalogued as to location, time and suspected event for retrieval and analysis later.

31 Claims, 2 Drawing Sheets

RAILWAY HAZARD ACOUSTIC SENSING, LOCATING, AND ALARM SYSTEM

FIELD OF THE INVENTION

This invention is a system to sense, identify and locate naturally occurring and man-made hazards that may present a danger to the safe movement of trains.

BACKGROUND OF THE INVENTION

The prior art in railway right-of-way safety, with regards to hazards, has advanced little in decades. The prior art safety measures consist of Slide Detector Fences, Wash Out Detectors (WOD), monitoring electrical continuity through the rails, and direct observation of the railway right-of-way. Only the WOD have been recently developed. These decades-old safety measures continue to be installed.

A Slide Detector Fence (SDF) consists of a number of horizontal wires strung about 30 centimeters apart on a series of vertical wood poles typically spaced five to twenty meters apart. The poles are placed parallel to the railway track on the side that is susceptible to rockfalls. A rockfall or slide is detected by loss of electrical continuity when a single fragile wire is broken.

There are several problems with SDF. The wires can be broken by something as insignificant to safety as an animal or a tree branch. The SDF cannot discriminate between a small rock and a large boulder. The SDF must be repaired after each break or detection. Until repaired, all trains passing the SDF are required to pass the entire length of the SDF at a speed that will allow stopping within the range of vision, for example; short of a blockage or other hazard. This slowing of rail traffic causes a slowdown of opposing rail traffic in single track territory, backing up traffic in both directions. Sometimes additional relief train crews are required to complete the train's trip. Additionally, slowly traveling trains expend extra fuel to reaccelerate. Locating and repairing the break can be time consuming due to the remoteness of the areas where these fences are typically found, and the length of a single circuit of fence which can extend to upwards of one kilometer in length. SDF are not suitable for areas of slope near the natural angle of repose. In this type of region, there are boulders that may be loosened by a freeze-thaw cycle or rain; however, too many animals can break the SDF in such a region, so that the number of false alarms prohibits the use of SDF. SDF are primarily deployed between the tracks and near-vertical cliffs.

The WOD are installed to stop catastrophic accidents such as the Canadian National Rail (CN) accident at Conrad, B.C., Canada on Mar. 26, 1997. In that accident, two locomotives and eight rail cars derailed into a large depression that was created by a landslide. The two CN crew members on board the lead locomotive were killed. The diesel fuel caught fire and ignited another standing train's load of sulfur. More details are available in the Transport Safety Board of Canada (TSB) report No. R97V0063.

A WOD has two forms. The original form, installed on CN's main line, consists of a wire, fabricated from material similar to the SDF, with weights attached. The wire and weights assembly is buried beneath the right of way, in an area of suspect earth stability. Should the earth wash out or otherwise subside, the weights will break the wire causing a loss of electrical continuity which, in turn, activates a signal to warn approaching trains. There has never been a detection of subsidence on this system due to the very limited number of installations. An advance in WOD technology was made in late 1997. It involved the use of mercury tilt switches installed on posts inserted into the subgrade of the railway right-of-way. If the ground washes out or shifts to cause a change in attitude of the post, the mercury switch will tilt sufficiently to cause a loss of electrical continuity. Similarly, if the connecting wire is broken there will be a loss of electrical continuity. The loss of electrical continuity will trigger an alarm causing trackside signals to give a warning and a radio message to be broadcast to the trains nearby, informing their crew members that there is a suspected washout.

WOD are very limited in use. They are difficult to repair and expensive to install. During construction they disturb the track bed they are meant to protect. If they are installed too close to the surface, they may be disturbed by the normal subgrade movements caused by the trains. If installed too deeply, they may miss a small washout.

Another method of monitoring rail lines currently in use involves detecting a problem by sensing a loss of electrical continuity through the rail. A break may occur because of service stresses of trains and equipment, because of thermal contraction on the coldest of winter days, because the road bed subsides under the track, or because a rock strikes one of the rails with sufficient force. If either of the rails break, the loss of electrical continuity changes the block, interlocking or Centralized Traffic Control (CTC) trackside signals to their most restrictive indication. These signals are similar to an intersection traffic light. The signals do not, by themselves, stop any train; they must be acted on by the train crew, who must witness such a signal prior to rolling over the location of the break. Crews whose train has already traveled past the last one of these signals when a break occurs in the train's present block receive no indication of a broken rail.

The electrical continuity of the track can remain even if there is a sizable chasm created by a washout beneath the track. The Conrad accident had a chasm of about 70 meters of unsupported track that did not break until a train came upon it. Similarly, on Sep. 22, 1993, a barge, being shoved in dense fog, struck a span over Big Bayou Canot in Alabama USA. The bridge was knocked several feet out of alignment. Eight minutes later an Amtrak train derailed off the bridge at 116 km/h. (72 m.p.h.), killing 47 people. The rails, although bent and unable to support and guide a train, continued to be electrically continuous and therefore did not give any warning through the trackside signal system. More details are available in National Transportation Safety Board report adopted Sep. 19, 1994, Notation 6167B. In addition, rocks as large as automobiles can fall onto the track without breaking the sturdy rails.

The SDF, the original WOD, and the rail electrical continuity detection systems all depend on receiving a detection before the train crew observes the last signal on approach to the hazard. In many areas, the trackside signals are several kilometers apart. Thus, there is time for a hazard to occur without the crew receiving information through the trackside signal system.

Another method of track hazard detection depends on observation. A hazard may be seen by a member of the train crew during their tour of duty, during routine or random Track Patrols, or while investigating reports from the public.

Many of the areas that rockfalls and washouts occur are remote and are not frequented by the public. As well, these rights-of-way are private property and most railway companies discourage the public's presence. The trains run 24 hours a day. The public would be unlikely to see hazards except by daylight. The natural hazards that cause these accidents are most frequently caused by severe weather such as higher than normal rainfall. This weather is frequently accompanied by diminished visibility. These two conditions make the public less likely to be present or to observe hazards in remote areas. People traveling the roadways that parallel the tracks offer a good chance of spotting a dangerous situation. Even if a dangerous condition was sighted, the public may not be inclined or able to report it. These typically remote areas are not normally served by cellular phone companies and the railway's phone number may be difficult to obtain. Relying on the public to report hazards is simply not a dependable solution.

Routine or random track patrols can spot a hazard that has occurred. They can give, if conscientious enough, some insight into the possibility of emerging dangerous areas some of the time. In many cases, however, a hazard such as a rockfall occurs suddenly. The history of the area would indicate, with more accuracy, the likelihood of rockfalls. This is the type of area where SDF are installed. The two drawbacks of the patrols are the cost involved in manual observation and, in CTC, the delay to trains. A track patrol is typically a highway-rail vehicle; a pickup truck with an extra set of wheels attached that fit the rails, but of much smaller diameter and weight than standard rolling stock wheels. Rolling stock includes locomotives and standard rail cars, also referred to as 'equipment' in the Canadian Rail Operating Rules (CROR). A hydraulic system to raise and lower the extra set of wheels is provided. The patrols are used to precede a train along the track. The small diameter of wheels and need to stop short of a hazard may not permit the highway-rail vehicle to travel at speed over 40 km/h. Thus on 60 km/h (35 miles per hour) track, the patrol must wait for trains to pass, then get on the track, patrol, then get clear of the track and report to the Rail Traffic Control (RTC) staff typically 15 minutes minimum prior to the expected arrival of the next train. To be any closer than 15 minutes or 10 kilometers would not allow the following train to continue at full track speed because of the workings of the CTC signal system. Consequently, even if every train could be preceded by a patrol, conditions may change in the 15 minute period required between the safety inspection vehicle and the train. At present, CN has five patrols in about 200 kilometers (125 miles) of high risk track.

Generally, when a train is the first to encounter a hazard on the track, it cannot stop short of the hazard. Trains take a long distance to stop. Stopping distance is a function of, amongst other things: speed, track grade, brake set up, total weight of the train, steel-on-steel friction, and the length of the train. Steel-on-steel friction is, in most cases, less than half of that of rubber-on-pavement experienced by cars. Train length is significant because the air brake application can only propagate through the train at the rate of the speed of sound through the train's air brake pipe. The air brake pipe is built into all equipment with connecting hoses at each end of the equipment. This allows for control of the brakes on a series of rail cars from a locomotive, when the hoses are joined. This continuous air brake pipe propagates the changing air pressure required to actuate the brakes. It will take about 6 seconds for a change in pressure to propagate through an 1800 meter long (6000 foot) train. In other cases there may be little opportunity to see the hazard because of darkness, curved track, or snowfall. One hazard that is not easily seen is a change in the gauge of the track, sometimes caused by a rolling rock striking a rail. Gauge is the standard distance between the inside of the pair of rails.

Several types of remote-controlled companion or pilot railway cars have been proposed. They explore the track in front of the locomotive or train at a distance that allows the train to stop if a dangerous condition is detected. Examples of such systems can be found in U.S. Pat. Nos. 5,627,508 and 5,623,244 to Cooper et al. (1997), and U.S. Pat. No. 5,429,329 to Wallace et al. (1995). These inventions have not enjoyed commercial success because they require modifications to the CTC signal system. Furthermore, they are expensive to build and maintain and they occupy track that could be used for revenue generating rolling stock, most noticeably when train and companion car are in a siding. Less noticeably, but more significantly, these inventions would cause a greater spacing of trains proceeding in either direction, much like the track patrols. These pilot vehicles do not detect a dangerous event that occurs between the time at which it inspects the track and the time at which the train arrives. If notice could be given to the train crew, an emergency train brake application may reduce the negative consequences. For example, a rock slide may derail less rail cars if advance notice was given. However, as yet, no pilot vehicle communicates with the RTC office.

One prior art system, U.S. Pat. No. 5,713,540 (1998) to Gerszberg et al, uses detected sound to indicate railway activity. The Gerszberg system monitors the rails in pairs and identifies a dangerous condition by noting the difference in detections between the rails. If a rock struck the track it would be heard louder on one rail when compared to the other rail. Also, the Gerszberg system generates an alarm when there is a very large sound detected on both rails. Such a system however, is unable to distinguish between a small event occurring near an acoustic sensor from a large event occurring at a distance. Also, some tracks have metal bars or concrete ties that tie the rails together. These may act as sound conductors and eliminate or substantially reduce the measurable difference between the sounds on each rail making it significantly less likely to detect the anticipated difference in sounds. The Gerszberg system has no locating feature. The physical event that was acoustically sensed cannot be located with any accuracy. It employs only microphones and has a lower limit of sound detection of 30 hertz. Rockfalls may be more easily detected by sensing vibrations of much lower frequencies. It has a digital signal processor to provide audio signature analysis but has no attenuation calculation to ascertain the original acoustic energy of the physical event. The Gerszberg system cannot be used near a public crossing or the initial filtered signals will require a higher threshold before generating an alarm. Comparing the pairs of detections between rails might generate a false alarm in cases of thermal expansion and accompanying rail creep. It has no feature that would stop an endangered train without the locomotive driver's actions. Lastly, the Gerszberg system cannot detect mud slides, snow and rock avalanches, and other low acoustic energy events that may be hazardous.

Before the 1980's, the conventional method of stopping a train was by opening an anglecock on the brake pipe and releasing some or all of the pressurized air. That was done from the locomotive, for controlled stops, or from the caboose for emergency stops. The locomotives are equipped with a special slow-reduction valve. During the 1980's, the art of remote train braking advanced somewhat with the development of an end of train device or the Sensing and Braking Unit (SBU). The SBU is a wireless transmitting and receiving box that is secured to the last car of a train, and replaces some functions of a caboose. The SBU is attached to the air brake pipe. One function of the SBU is to initiate an emergency brake application on the train when it receives a wireless communication signal. This gave the locomotive engineer the capacity to stop the train from the locomotive in emergency situations via an SBU attached to the last car. Should there be a pinched air hose or otherwise blocked brake pipe, the train could still be stopped. This system was meant for the exclusive use of the crew of that train only.

An object of the present invention is to provide an early warning system for trains which has the following advantages:

(a) continuous monitoring of the track even after a train passes the last signal on approach to a hazard;

(b) instant RTC, crew and train notification of a hazard so the train can be stopped at any time;

(c) low operational costs, namely the price of electricity to operate sound recognition and alarm equipment;

(d) low maintenance costs with no need for repairs after a detection of a fallen rock;

(e) post hazard notification allowing trains to resume normal track speed after the first train has passed the location of the suspected hazard, (f) a method of deducing the exact location of the suspected hazard, so a train need only be restricting its speed on approach to that location;

(g) an alarm system where the train need not slow down if a track patrol can inspect the potential hazard prior to the train's arrival;

(h) accurate and automatic compilation of the location, time and type of event that caused the alarms;

(i) an ability to deduce the size and therefore the danger of a rockfall or physical event;

(j) an ability to sense vibration from physical events below 30 hertz;

(k) minimal use of fossil fuels and therefore environmentally friendly.

Further objects and advantages will become apparent from considering the ensuing description.

SUMMARY OF THE INVENTION

In accordance with the present invention, which is a system to detect, locate, and identify acoustic waves transmitted by the rails of a railway. These acoustic waves, comprising sound and vibration, will be compared with acoustic waves of known events to identify the type of the phenomena that caused them. If a dangerous situation is suspected from the information collected, the relevant train and the RTC staff can be notified to assist in the protection of the train, its crew, the right of way, and the public.

DETAILED DESCRIPTION OF THE PREFERRED EMBODIMENT

Figure 1:
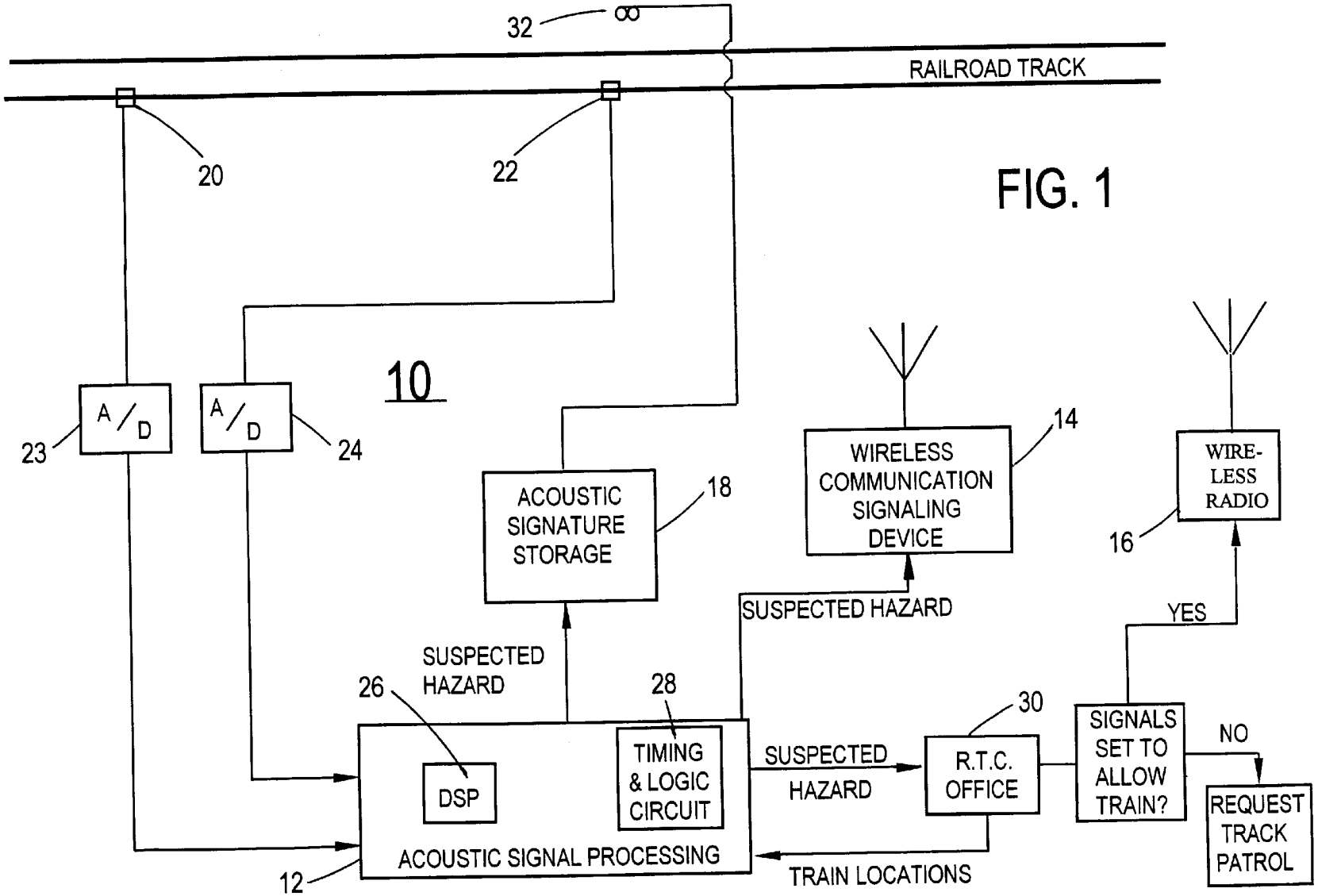
FIG. 1 is a block diagram of one embodiment of the railway warning system according to the present invention.

A typical embodiment of this system starts at a microphone, geophone, listening device, or acoustic sensor (AS) attached to one rail. There is an acoustic coupling between the rail and the AS. This coupling can be a sound bar, or simply a direct or indirect mechanical connection between the rail and AS. The dynamic sensitivity range of the AS should be as wide as possible to ensure complete detection of all potential acoustic sources. Seismic survey equipment such as geophones detect vibration in the range of 2 to 2500 hertz but an upper limit of 30 kilohertz would be advisable. The dynamic range of hazards which form potential acoustic sources may dictate the AS is a combination of transducers such as a microphone and geophone. The AS must be electrically isolated to avoid interference with existing track circuit operation. Other AS's are placed along the rail at a distance. The distance is determined by first determining the acoustic energy of a physical event that would be hazardous. The AS's are then spaced so that event can be detected by at least two AS's attached to the same rail. Groups of AS's are wired to a single location so that the acoustic signal from neighboring AS's may be compared. The signals are fed into an analog to digital converter and then brought together at a location that has an acoustic analyzer, or acoustic signal processing unit, typically a sound and vibration recognition computer. This computer, comprising a digital signal processor (DSP) and timing and logic circuitry has information on acoustic signatures (AcSig) transmitted by the rail. This device has logic circuitry that can compare the AcSig from each AS, then aided by artificial intelligence interpretation, identify the AcSig, its location and its energy at that location. The acoustic signal processing unit has circuitry to determine the acoustic energy of an AcSig that is not recognized and to compare the time of arrival of each AcSig at each AS. It can also discern whether the AcSig's received from two AS's were from the same source. The acoustic signal processing unit can detect the strongest AcSig and ascertain the location of the source by comparing the time delay from the AcSig's from other proximate AS's.

The computer has the ability to record the time, location, intensity, and suspected or identified type of hazard. This data is stored in an AcSig storage device.

The computer has circuitry to send out a warning when an AcSig of predetermined energy, as calculated at the source, is received. This warning may be fiber optically transmitted to the RTC office and the block or CTC trackside signal system. The train crew would be notified by radio. Also, if dictated by a lack of response time, a wireless communication frequency may be sent to the SBU, activating the emergency braking feature.

Additionally, a sound or vibration inducer may be installed on the rail. It imparts a unique acoustic signature into the rail. This unique or predetermined acoustic signature need only be detected by one AS.

DETAILED DESCRIPTION OF THE DRAWINGS

Referring now to FIG. 1, there is shown one embodiment of a warning system according to the present invention hereinafter referred to as warning system 10. As shown, warning system 10 has a pair of acoustic sensors 20 and 22 attached to one rail, an analog to digital converter 23 and 24 coupled to each acoustic sensor with outputs which are fed into an acoustic signal processing unit 12. The acoustic signal processing unit 12 contains a digital signal processor 26 and a timing and logic circuit 28. The acoustic signal processing unit 12 is coupled to an acoustic signature storage device 18 a wireless communication signaling device 14 and the Rail Traffic Control (RTC) office 30. The RTC office 30 staff have the use of a wireless radio 16 to talk to the train crews.

In operation, acoustic sensors 20 and 22 detect sound or vibration on the same rail and output analog signals to their respective analog-to-digital converters is 23 and 24. The digital signals are input to the acoustic signal processing unit 12. The digital signal processor 26 compares and identifies signals that were from the same physical event. These matched signals are then passed to the timing and logic circuit 28. It will compare the acoustic signatures to known acoustic signatures. If the AcSig is in the safe category, no further action is taken. If in the unsafe category, the location is deduced, the initial acoustic energy is determined, and if a minimum threshold is exceeded, a suspect condition is identified. The acoustic signal processing unit 12 outputs to an acoustic signature storage device 18 and the RTC office 30. Should the timing and logic circuit 28 locate a train that is approaching the detected suspect location from the RTC office 30, between sensors 20 and 22, the acoustic signal processing unit 12 will broadcast a signal from the wireless communication signaling device 14 that will initiate a brake pipe pressure reduction on any approaching train. When there is input to the acoustic signature storage device 18, it will assure the trackside signal 32 is at its most restrictive indication. All suspected hazardous condition information will be transmitted to the RTC office 30 so the staff can request a track patrol of the suspect track, make a broadcast by wireless radio 16 to the trains and reset the trackside signal 32.

Figure 2:
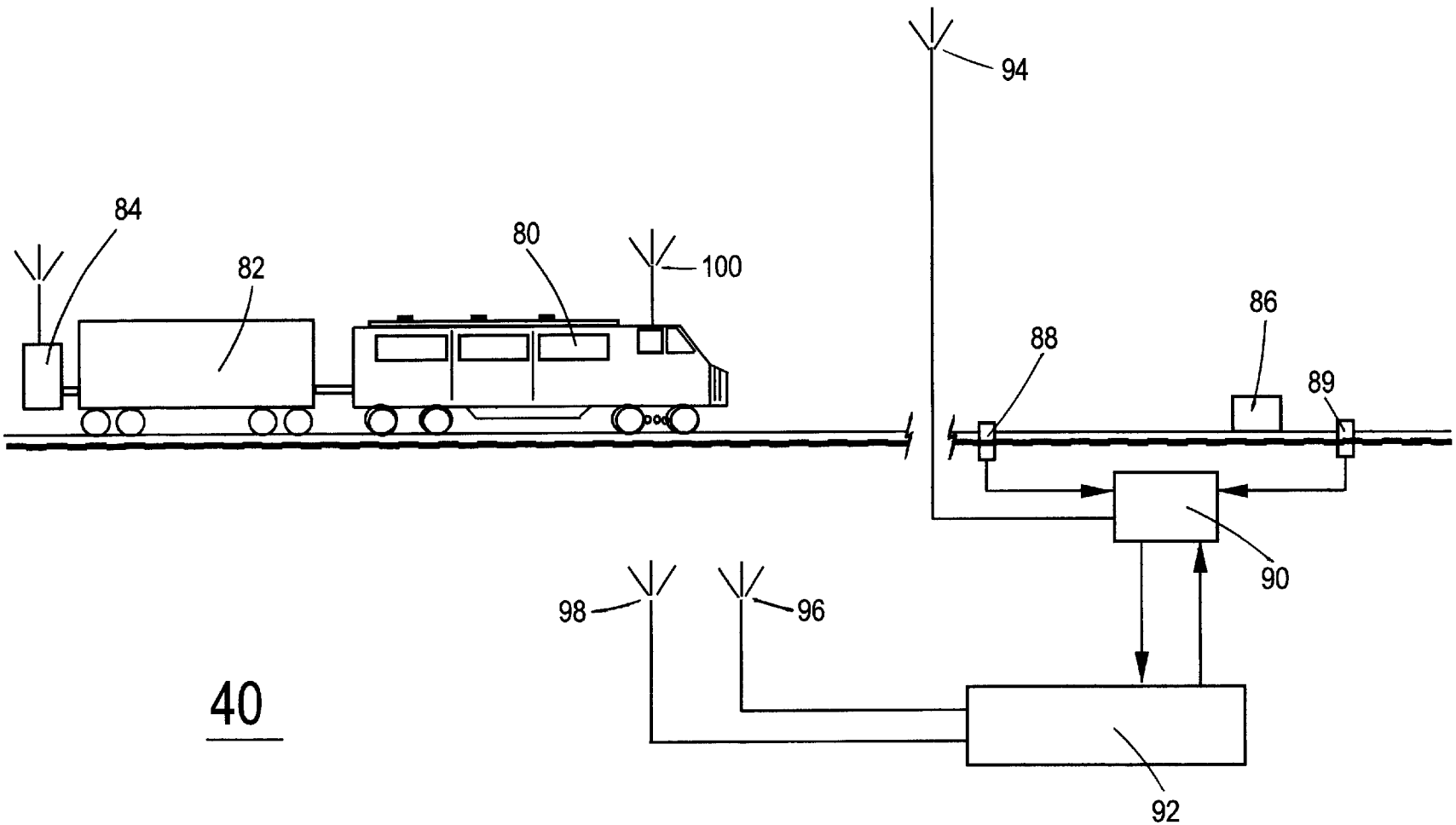
FIG. 2 is a diagram of one embodiment of the alarm system to notify and stop an endangered train.

Referring now to FIG. 2, there is shown one embodiment of a remote braking system according to the present invention hereinafter referred to as emergency remote braking system 40. Should there be a suspected hazardous physical event 86 sensed between acoustic sensor 88 and acoustic sensor 89 which is recognized by the acoustic signal processing unit, locator and logic unit 90 and should the system determine a train 80 is closely approaching, then an emergency broadcast is made of an emergency braking frequency through antenna 94 to be received by SBU 84. Information regarding the proximity of the train may be made by additional acoustic sensors (not shown) or may be obtained from the RTC office 92. Triggering the SBU causes application of the emergency brakes on the railway equipment 80 and 82. Should the acoustic signal processing unit, locator and logic unit 90 determine there is no immediate danger to trains from the suspected hazard then a message is sent to the RTC office 92 and there a decision can be made to take one of the following courses of action: talk by radio 96 to a Track Patrol (not shown), talk by radio 96 to the train crew through radio 100, or if required a radio signal may be communicated on an emergency braking frequency broadcast 98 to SBU 84.

Accordingly, the reader will see that the railway acoustic sensing and location assembly can be used to tremendously improve safety. It will save on environmental and equipment damage and will locate, with consistent accuracy, the location of natural hazard events. It can sense and respond to the natural hazard that has just occurred. It will reduce costs. It will save lives.

The early warning system is used in the following manner. First recordings are made of typical or representative AcSig's transmitted by the rail. These typical AcSig's include rolling stock (loaded and empty), locomotives (when stationary and with their diesel engines running, as engines from different manufacturers produce distinct sounds), switch points being moved, track units, high-rail vehicles, a locomotive bell ringing, a horn blowing, the sounds generated by motor vehicles and the public crossing the tracks, non dangerous natural phenomena (wind blowing over the rail, rain falling on the rail, thunder, animals and birds near and on the tracks), and finally thermal expansion and the accompanying rail creep atop the ties caused by solar heating of the rail.

After recording background sounds, the AcSig's of events that are potentially hazardous to train travel must be recorded. These potentially hazardous AcSig's include: rocks falling and striking the rails and ties, running water or mud hitting the rails and ties, sun kinks occurring (an extreme form of thermal expansion which causes the rail to go out of alignment taking on an 's' shape and usually carry the ties and some ballast along with the rails), washouts that leave the rail suspended over a chasm, dangerous rolling stock sounds such as a derailed wheel striking the ties, and vandalism.

Finally, a distinct sound must be recorded which is different from all the others. The sound must be capable of being economically reproduced by a manufactured sound inducer. It may be electrical or mechanical or other in origin. An electromagnetic exciter similar to U.S. Pat. No. 4,402,210 (expired) may be used for a mechanical sound inducer.

The collected AcSig's are now classified into safe or unsafe AcSig's. The safe AcSig's include the normal running sounds of the train. The unsafe AcSig's include the natural phenomena that are in the washout and rockfall category or vandalism. An acoustic energy threshold must be determined for the naturally occurring unsafe AcSig.

The system is then activated. Any detections are sent to a location near the site or transmitted to a remote location that contains the means for analysis. These detections are compared to the collected AcSig and recognition is aided by artificial intelligence interpretation. Typical transmission modes are by wire or fiber optic cable that run beside the rail bed. The cable is used for information transmission and to activate the rail signal system. Another method may be to analyze the information at the site and transmit a dangerous condition warning by radio or satellite.

With a series of AS's attached to the same rail, the exact location of the AcSig can be deduced when detected between and by at least two AS's. The time delay can be sensed by timing the of arrival of the AcSig at the first and second AS to detect the AcSig. The rail gives a near constant and uniform rate of sound travel of about 5100 meters per second (m/s). The distance must be determined between AS's, by survey methods and by timing a sound traveling from one AS to the next AS. Using real time for when AcSig are received, the distance from the midpoint between the two AS's is d. Then d=2550 m/s[AS1−AS2] where AS1 is the time of receiving the AcSig at the first AS, AS2 is the time at the second AS. This will give the location from the midpoint assuming the AcSig is between the two AS's. If the physical event was outside the pair of AS's the time delay between the two AS's will be a maximum and the calculation will erroneously conclude the event occurred at one AS. In this case, the string of acoustic sensors will need to be extended. The 2550 m/s represents one half the speed of sound through the rail. Different values will be required for different metals or materials. Acoustic energy at the source of the physical event can then be deduced by comparing the acoustic energy at the two strongest AS's attached to the same rail and by calculating the location by time delay of the AcSig and the acoustic decay or attenuation of the rail and the distance traveled by the AcSig. This will yield two calculations from the same event, for comparison of accuracy.

In some cases, snow or mud slides may not produce a great deal of acoustic energy. This may be more prevalent after a snowfall covers the rail reducing the acoustic transmission properties of the rail. To detect these slides, unique or predetermined acoustic signature inducers may be installed on the rail and the predetermined AcSig relayed to an AS can be analyzed for consistency. Sound anomalies or a change in attenuation would indicate some physical change has occurred between the acoustic inducer and the AS. For a use such as this, only one AS is required to receive the unique AcSig and to indicate a dangerous situation. The location will not be known exactly but may be pinned to a location between the source and receiver points. As there is insufficient acoustic energy from the event itself to determine an event has occurred, this method offers a practical way to detect a dangerous event. This technique may also be used to start operation of the CTC switch point heaters that melt snow thus allowing the rail switch points to move and line the route for an approaching train.

When a perceived dangerous AcSig is recognized, there will be an alarm initiated. The same is true for an AcSig that is not recognized and is above a predetermined energy threshold. The alarm will always include storing information regarding time, location, intensity, and detected or suspected event in a sound file or acoustic signature storage device. The alarm can be registered at the RTC office and may be directed to trains. If in signalized territory, the alarm can trigger the trackside signals, changing them to their most restrictive indication as seen by a train crew on approach to the detected dangerous AcSig location. The alarm may also trigger a radio broadcast to warn the crew by voice, specifying the location of the detection.

There are three levels of alarms that can be initiated. Firstly, if no train is closely approaching, that is, if the signals are not set to allow passage of any train, the RTC staff can request a patrol of that track location. Secondly, if a train is somewhat close, the RTC staff can make an emergency broadcast to the train crew to stop. The RTC staff may then allow the train to proceed but prepare to stop short of the suspect location. There the train crew would do a visual inspection. Thirdly, if too close for verbal instructions to the crew and the train was equipped with SBU or other wireless communication controlled brake pipe air pressure reducing device, then the RTC office or field logic circuitry can apply the emergency brakes to the train. The train locations and directions can be ascertained by the CTC block signal system, the RTC office, by satellite, or through this invention. The SBU unit numbers would be kept updated by the RTC office or an additional Universal Emergency Braking Frequency (UEBF) would be installed on each SBU for the specific use of the RTC staff. This SBU or UEBF would be used to stop a train short of a controlled location when detections indicate it is not otherwise decelerating at the required rate.

All detections of significance can be compiled to aid in producing rockfall mileage-frequency graphs or correlated manually with information reported from track patrols. This will aid in identifying areas for rock scaling scheduling and other remedial work.

CONCLUSIONS, RAMIFICATIONS AND SCOPE

Although the description above contains many specificities, these should not be construed as limiting the scope of the invention but merely providing illustrations of some of the presently preferred embodiments of this invention. Many others are possible. For example, the system can be simplified in analysis of AcSig's by turning off the system when rolling stock approaches, sound filters may be employed or substituted to detect only specific physical events, both rails could be monitored and compared, the duration of an unrecognized high energy sound could be used to aid in determining a dangerous condition, sound inducers may be triggered by the approaching trains, such that when rolled over in series, the inducers will indicate speed and location, all AcSig's could be sent by radio frequency to a remote location for comparison and analysis, analog-to-digital conversions can be made at any convenient location in the system, accelerometers or sonar devices could be used for the acoustic sensors, a field location feedback system could be developed for maintenance personnel by which a location could be determined by striking the rail with any solid object, to ascertain if the location just struck was the exact location of a recorded rockfall that may have occurred months earlier. This system could be used for erecting signs and flags that are required by railway operating rules. Finally a mechanical, electrical, explosive charge or other chime can be wired to the track, buried in the fill and in cases of a washout, would produce an acoustic signature. Track torpedoes or other small explosive devices would offer an economical way of producing a notice of track subsidence.

The remote braking feature may be used when a train may be endangered by suspected runaway rail cars as in TSB report No. R96C0172. In that case the RTC office had 19 minutes' warning of a problem but could not identify the cause until after the cars collided with a train, resulting in three deaths. The SBU wireless communication frequency could be used, and when required, a backup UEBF could be broadcast.

Also, the description should not limit the industrial applications. Any mode of transportation that has a substantially continuous metal guideway or frame could propagate the acoustic waves with a near constant velocity. Even dissimilar metals or materials can be accounted for. Therefore, any metal guideway transportation system can adapt this device for use. Some examples follow.

This invention can be applied to a subway or light rail passenger transport system to detect rare but potentially dangerous or fatal hazards. It can be adapted to monorail systems or magnetic levitation guideways. It can be applied to other modes of transport. A mine ore transport system may have analogous problems. Conveyor belt systems are sometimes jammed with the commodity they convey thus destroying rollers or a length of belt until detected. AcSig of these destructive processes could be employed to locate and stop the machinery. Also amusement rides that are guided by steel guideways can be monitored for hazards. All of the above can be categorized as metal guideway transportation systems even if acoustic sensors are not attached to any metal part.

The above description includes exemplary embodiments and methods of implementing the present invention. References to specific examples and embodiments in the description should not be construed to limit the present invention in any manner, and is merely provided for the purpose of describing the general principles of the present invention. Accordingly, the scope of this invention should be determined not by the embodiments presented here, but by the appended claims and their legal equivalents.

What is claimed is:

1. A method for detecting a physical event which affects a metal guideway transportation system comprising the steps of:

(a) introducing predetermined acoustic waves onto a metal guideway of said metal guideway transportation system at a first location, said predetermined acoustic waves propagating via said metal guideway;

(b) acoustically monitoring said metal guideway at a second location; and (c) detecting a change in said predetermined acoustic waves, said change indicates a physical event has occurred between said first location and said second location whereby said metal guideway transportation system may be acoustically monitored substantially continuously, for low acoustic energy events.

2. A method according to claim 1, wherein said metal guideway is a rail and sad metal guideway transportation system is a railway.

3. A method according to claim 1, further comprising at least one of the steps of:

(a) evaluating the severity of said physical event; and (b) responding to said physical event in a manner whereby safe operation of said metal guideway transportation system may be maintained.

4. A method according to claim 3, wherein said evaluating step is accomplished by measuring a change of acoustic energy detected in said predetermined acoustic waves whereby ascertaining if said physical event poses a threat to safe operation of said metal guideway transportation system.

5. A method according to claim 3, wherein said responding step is comprising at least one of the steps of:

(a) ignoring said physical event when said physical event is determined to be non-hazardous to safe operation of said metal guideway transportation system;

(b) initiating a plurality of alarms when said physical event is suspected to be hazardous to safe operation of said metal guideway transportation system;

(c) changing an indicator of a signalling device, said signalling device alerts an operator of a vehicle travelling on said metal guideway transportation system, when said physical event is suspected to be hazardous to safe operation of said metal guideway transportation system;

(d) stopping operation of a portion of said metal guideway transportation system when said physical event is suspected to be hazardous to safe operation of said metal guideway transportation system; and (e) remotely initiating a brake application on said vehicle travelling on said metal guideway transportation system when said physical event is suspected to be hazardous to safe operation of said vehicle.

6. A method according to claim 5, wherein said vehicle is a train, said signalling device is a trackside signal, and said operator is a member of the crew of said train.

7. A method according to claim 5, wherein said remotely initiating step is accomplished by wireless communication, said wireless communication includes providing transmitting at a remote location and receiving communication on board said vehicle.

8. A system for detecting a physical event which affects a metal guideway transportation system comprising:

(a) an acoustic inducer operative to introduce predetermined acoustic waves onto a metal guideway of said metal guideway transportation system at a first location;

(b) an acoustic sensor acoustically coupled to said metal guideway of said metal guideway transportation system at a second location, said acoustic sensor operative to monitor said metal guideway and to sense acoustic phenomena including said predetermined acoustic waves as they are propagating via said metal guideway and to produce a corresponding analog electrical signal;

(c) a signal conditioner electrically coupled to an output of said acoustic sensor and operative to convert said analog electrical signal to a conditioned signal representative of said acoustic phenomena including said predetermined acoustic waves; and (d) an acoustic signal processing unit operatively coupled to said signal conditioner, said acoustic signal processing unit is operative to classify said conditioned signal, including a change in the predetermined signal, said change indicates said physical event has occurred between said first location and said second location.

9. A system according to claim 8, wherein said acoustic signal processing unit is further programmed to evaluate the severity of said physical event and whether said physical event poses a threat to safe operation of said metal guideway transportation system and to respond to said physical event in a predetermined manner thereby maintaining safe operation of said metal guideway transportation system.

10. A system according to claim 8, wherein said metal guideway is a rail and said metal guideway transportation system is a railway.

11. A system according to claim 8, further comprising at least one of:

(a) an alarm triggering device operative to initiate a plurality of alarms when said acoustic signal processing unit indicates said physical event may be hazardous to safe operation of said metal guideway transportation system;

(b) an indicator triggering device operative to change an indicator of a signalling device, said signalling device alerts an operator of a vehicle travelling on said metal guideway transportation system, when said acoustic signal processing unit indicates said physical event may be hazardous to safe operation of said metal guideway transportation system;

(c) a controlling device to stop operation of a portion of said metal guideway transportation system when said acoustic signal processing unit indicates said physical event may be hazardous to safe operation of said metal guideway transportation system; and (d) a transmitting unit operative to remotely trigger application of brakes to said vehicle travelling on said metal guideway transportation system when said acoustic signal processing unit indicates said physical event may be hazardous to safe operation of said vehicle.

12. A system according to claim 11, wherein said vehicle is a train, said signalling device is a trackside signal, and said operator is a member of the crew of said train.

13. A method of monitoring a metal guideway transportation system to detect a physical event comprising the steps of monitoring a metal guideway of said metal guideway transportation system at a pair of disposed apart monitoring locations to detect acoustic waves produced by said physical event, said physical event occurring substantially between said disposed apart monitoring locations, said acoustic waves propagating via said metal guideway, having sufficient acoustic energy to be detected at both of said pair of disposed apart monitoring locations and locating said physical event by comparing a relative time of arrival of said acoustic waves at said pair of disposed apart monitoring locations.

14. A method according to claim 13, wherein said metal guideway is a rail and said metal guideway transportation system is a railway.

15. A method according to claim 13, further comprising at least one of the steps of:

(a) classifying said physical event;

(b) evaluating the severity of said physical event; and (c) responding to said physical event in a manner whereby safe operation of said metal guideway transportation system may be maintained.

16. A method according to claim 15, further comprising the steps of:

(a) storing the classified physical event; and (b) storing the location of said physical event, whereby areas/of said metal guideway transportation system which are prone to a type of physical event may be identified.

17. A method according to claim 15, wherein said classifying step is comprising at least one of the steps of:

(a) filtering said acoustic waves, and (b) comparing said acoustic waves to known acoustic signatures, whereby a condition that may affect said metal guideway transportation system may be identified.

18. A method according to claim 15, wherein said evaluating step is accomplished by measuring the acoustic energy of the detected acoustic waves and calculating the unattenuated acoustic energy at its source whereby ascertaining if said physical event poses a threat to safe operation of said metal guideway transportation system.

19. A method according to claim 15, wherein said responding step is further comprising at least one of the steps of:

(a) ignoring said physical event when said physical event is determined to be non-hazardous to safe operation of said metal guideway transportation system;

(b) initiating a plurality of alarms when said physical event is suspected to be hazardous to safe operation of said metal guideway transportation system;

(c) changing an indicator of a signalling device, said signalling device alerts an operator of a vehicle travelling on said metal guideway transportation system, when said physical event is suspected to be hazardous to safe operation of said metal guideway transportation system;

(d) stopping operation of a portion of said metal guideway transportation system when said physical event is suspected to be hazardous to safe operation of said metal guideway transportation system; and (e) remotely initiating a brake application on said vehicle travelling on said metal guideway transportation system when said physical event is suspected to be hazardous to safe operation of said vehicle.

20. A method according to claim 19, wherein said vehicle is a train, said signalling device is a trackside signal, and said operator is a member of the crew of said train.

21. A method according to claim 19, wherein said remotely initiating step is accomplished by wireless communication, said wireless communication includes providing transmitting at a remote location and receiving communication on board said vehicle.

22. A system for detecting and locating a physical event which affects a metal guideway transportation system comprising:

(a) a pair of acoustic sensors acoustically coupled to a metal guideway of said metal guideway transportation system at disposed apart locations and each of said pair of acoustic sensors operative to detect acoustic waves produced by said physical event, said physical event occurring substantially between said disposed apart locations, and said acoustic waves propagating via said metal guideway to each of said pair of acoustic sensors thereby producing corresponding analog electrical signals;

(b) a pair of signal conditioners electrically coupled to respective outputs of said pair of acoustic sensors, each of said pair of signal conditioners operative to convert said analog electrical signals to conditioned signals representative of said acoustic waves of said physical event;

(c) an acoustic signal processing unit operatively coupled to said pair of signal conditioners, said acoustic signal processing unit is operative to process said conditioned signals to locate said physical event by sensing a relative time of arrival of said acoustic waves.

23. A system according to claim 22 wherein said acoustic signal processing unit is further programmed to determine intensity of said pair of conditioned signals.

24. A system according to claim 23, further comprising an acoustic signal storage device operative to store said conditioned signals of said physical event, building a library of acoustic signatures, and to store the location of said physical event, whereby areas of said metal guideway transportation system prone to a type of physical event may be identified.

25. A system according to claim 23, wherein said acoustic signal processing unit is further programmed to perform at least one of:

(a) classifying said physical event;

(b) evaluating the severity of said physical event; and (c) responding to said physical event in a manner whereby safe operation of said metal guideway transportation system may be maintained.

26. A system according to claim 25, further comprising at least one of:

(a) an alarm triggering device operative to initiate a plurality of alarms when said acoustic signal processing unit indicates said physical event may be hazardous to safe operation of said metal guideway transportation system;

(b) an indicator triggering device operative to change an indicator of a signalling device, said signalling device alerts an operator of a vehicle travelling on said metal guideway transportation system; when said acoustic signal processing unit indicates said physical event may be hazardous to safe operation of said metal guideway transportation system, (c) a controlling device to stop the operation of a portion of said metal guideway transportation system when said acoustic signal processing unit indicates said physical event may be hazardous to safe operation of said metal guideway transportation system; and (d) a transmitting unit operative to remotely trigger application of brakes to said vehicle travelling on said metal guideway transportation system when said acoustic signal processing unit indicates said physical event may be hazardous to safe operation of said vehicle.

27. A system according to claim 26, wherein said vehicle is a train, said signalling device is a trackside signal, and said operator is a member of the crew of said train.

28. A system according to claim 26, wherein said transmitting unit is a remote part of a wireless communication system with at least one corresponding receiving unit on board said vehicle.

29. A system according to claim 22, wherein said metal guideway is a rail and said metal guideway transportation system is a railway.

30. A geophone acoustically coupled to a rail of a railway and acoustic analyzing means, operatively coupled to said geophone, for recognizing a rockfall from acoustic energy sensed, said acoustic energy propagating substantially via said rail.

31. A physical event detection device comprising two disposed-apart geophones acoustically coupled to a rail of a railway and acoustic analyzing means operatively coupled to said two disposed-apart geophones, whereby substantially simultaneous acoustic detection of the waves travelling via said rail by said two disposed-apart geophones above a predetermined threshold indicates occurrence of a significant physical event.

* * * * *